US005212736A

United States Patent [19]

Tsukagoshi

[11] Patent Number: 5,212,736

[45] Date of Patent: May 18, 1993

[54] RIBBON SPEAKER

[75] Inventor: Tsunehiro Tsukagoshi, Saitama, Japan

[73] Assignee: Pioneer Electronic Corporation, Tokyo, Japan

[21] Appl. No.: 738,650

[22] Filed: Jul. 31, 1991

[30] Foreign Application Priority Data

Aug. 8, 1990 [JP] Japan ..... 2-211390
Sep. 28, 1990 [JP] Japan ..... 2-259891

[51] Int. Cl.[5] ..... H04R 25/00

[52] U.S. Cl. ..... 381/203; 381/202; 381/190

[58] Field of Search ..... 381/191, 190, 173, 202, 381/203; 181/168; 310/324

[56] References Cited

U.S. PATENT DOCUMENTS 3,564,163 2/1971 Hobrough ..... 381/202
4,027,111 5/1977 Kasatkin et al. ..... 381/202
4,216,271 8/1980 Takeuchi et al. ..... 181/168
4,550,228 10/1985 Walker et al. ..... 381/203
4,726,443 2/1988 Ugaji et al. ..... 181/168

FOREIGN PATENT DOCUMENTS 3618241 12/1987 Fed. Rep. of Germany ..... 381/191

OTHER PUBLICATIONS

Japanese Journal of Applied Physics, vol. 29, No. 3, Mar., 1990, pp. L486–L489.

*Primary Examiner*—Jin F. Ng
*Assistant Examiner*—Huyen D. Le
*Attorney, Agent, or Firm*—Nikaido, Marmelstein, Murray & Oram

[57] ABSTRACT

A vibrating diaphragm is disposed in a magnetic gap. The diaphragm comprises two organic films superimposed on each other, and two metal films overlaid on the organic films, respectively. One of the organic films has a smaller polarization and the other organic film has a large polarization. Both metal films are different in work function, and electrically connected by a metal film. Electric current is supplied to the vibrating diaphragm to vibrate it.

4 Claims, 4 Drawing Sheets

RIBBON SPEAKER

BACKGROUND OF THE INVENTION

The present invention relates to a ribbon speaker wherein a diaphragm thereof is improved to provide an increased transduction efficiency.

A loudspeaker provided in an audio system is an electroacoustic device that converts electric signals (electrical energy) into acoustic signals (sound energy) Electrodynamic loudspeakers are widely used today.

A typical electrodynamic loudspeaker uses a coil and diaphragm arrangement in which a voice coil is fixed at the center of a conical paper diaphragm that is free to move in an annular gap. A strong magnetic field, produced by either a permanent magnet or an electromagnet, is applied across the gap. The audio signal is input to the coil as alternating current, causing it to move in the magnetic field as a result of electromagnetic induction. The diaphragm is thus caused to vibrate at the same frequency as the alternating current and sound waves are produced by it.

Another type of the electromagnetic loudspeaker is a ribbon speaker having a vibrating diaphragm which serves both as the coil and the diaphragm. Referring to FIG. 6, the ribbon speaker comprises a pair of iron yokes 1 and 1*a* and a magnet 2 provided between the yokes 1 and 1*a*. A vibrating diaphragm 4 made of a good conductive material is disposed in a magnetic gap 3 between the yokes 1 and 1*a* so as to oppose the magnet 2. The diaphragm 4 is tensed in the longitudinal direction thereof by a pair of electrodes (not shown). When audio signal (alternating current) is applied to the diaphragm 4 in the magnetic field, the diaphragm 4 is forced to move in a direction perpendicular to those of the magnetic field and the current, as shown by the thumb in FIG. 7 describing Fleming's left-hand rule. As the diaphragm 4 vibrates, sound waves radiates.

Since the diaphragm 4 of the ribbon speaker is directly subjected to the electromagnetic force, causing the diaphragm 4 to vibrate, an extremely improved transduction efficiency is achieved. In the conventional speaker with the voice coil, the voice coil is apt to be partially vibrated, thereby causing irregularity in damping effect dependent on the electromagnetic force. Since the entire diaphragm 4 is vibrated, the damping efficiency is improved in the ribbon speakers. Hence the ribbon speakers is superior in frequency response, transient characteristics and in restraining harmonic distortion, thereby remarkably improving the sound quality.

However, in order to extend the range of the low-frequency response, the width of the diaphragm 4 is increased, so that the magnetic gap 3 is widened. Accordingly, the magnetic flux density in the gap decreases, rendering the efficiency of the speaker to decrease.

The efficiency of the ribbon speaker is inversely proportional to $\rho_R{}^{\bullet}K_R$ where $\rho_R$ and $K_R$ are specific gravity and electrical resistivity of the material of the diaphragm, respectively. In order to increase the efficiency, it is preferable to use a material having a low specific gravity and low resistivity. That is, if the specific gravity of the material is decreased, a large vibration is obtained at a small magnetic force, since the mass of the diaphragm is decreased. Furthermore with a material having a low electrical resistivity, the resistance of the diaphragm 4 can be reduced without increasing the cross-sectional area and hence the mass thereof, thereby reducing the loss of the audio current due to Joule heat.

Conventional materials that satisfy these requirements are metals such as aluminum, the $\rho_R\sqrt{K_R}$ value of which is $4.4\times10^{-1}$ kg/m$^3\sqrt{\Omega}$.m and beryllium, the $\rho_R\sqrt{K_R}$ value of which is $3.8\times10^{-1}$ kg/m$^3\sqrt{\Omega}$.m. The other material is, for example, a plastic film coated with aluminum. The aluminum and beryllium have far lower $\rho_R\sqrt{}_R$ value than other metals such as copper ($\rho_R\sqrt{K_R}=11.7$ kg//m$^3\sqrt{\Omega}$.m) and silver ($\rho_R\sqrt{K_R}=30.1$ kg//m$^3\sqrt{\Omega}$.m) In particular, beryllium has a lower value than any other existing metal.

However, the efficiency of the ribbon speaker provided with an aluminum or beryllium diaphragm has inferior efficiency, only up to 1 to several percent in those for higher audio frequencies. It is further difficult to realize speaker for reproducing middle audio frequencies, let alone a speaker for lower audio frequencies.

On the other hand, a plastic film coated with aluminum by evaporation or sputtering is advantages in that the mass of the diaphragm 4 is small. However, the non-conductive plastic film increases the resistance of the diaphragm so that, the $\rho_R\sqrt{K_R}$ value increases. Thus in principle, the efficiency of such a speaker is lower than the speaker employing the metal diaphragm. The metal coated plastic film diaphragm, with which only inferior efficiency and performance are provided, is virtually unused in practice.

An object of the present invention is to provide a ribbon speaker where the transduction efficiency and the performance thereof may be improved.

According to the present invention, there is provided a ribbon speaker having a vibrating diaphragm disposed in a magnetic gap, comprising the vibrating diaphragm comprising first and second organic films superimposed on each other, and first and second metal films overlaid on the first and second organic films, respectively, the first organic film having a smaller polarization and the second organic film having a large polarization, the first and second metal films being different in work function, a third metal film electrically connecting the first and second metal films, and means for supplying current to the vibrating diaphragm.

In an aspect of the invention, the vibrating diaphragm has a ribbon shape, and the means are a pair of electrodes secured to both ends of the diaphragm.

In another aspect, the vibrating diaphragm has a closed loop, and the means is an exciting coil provided around a part of diaphragm.

The other objects and features of this invention will become understood from the following description with reference to the accompanying drawings.

DETAILED DESCRIPTION OF THE PREFERRED EMBODIMENTS

Figure 1:
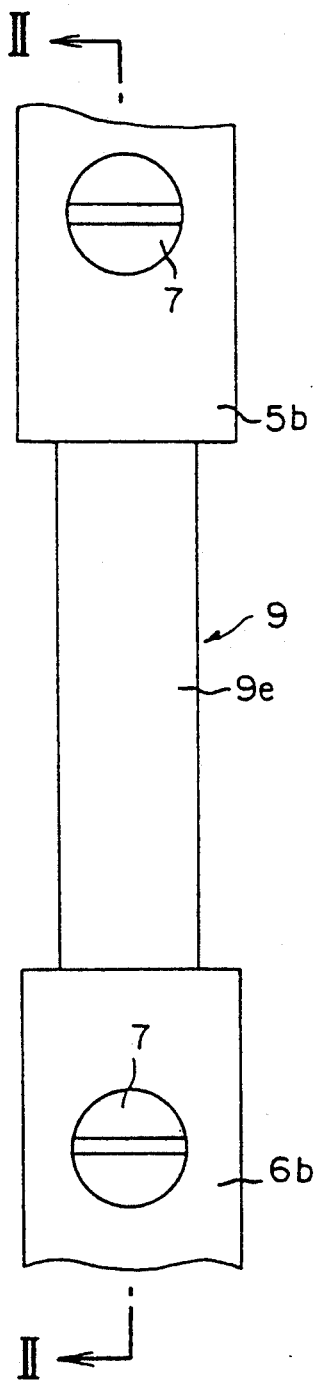
FIG. 1 is an elevational view of a part of a ribbon speaker to which the present invention is applied.
Figure 2:
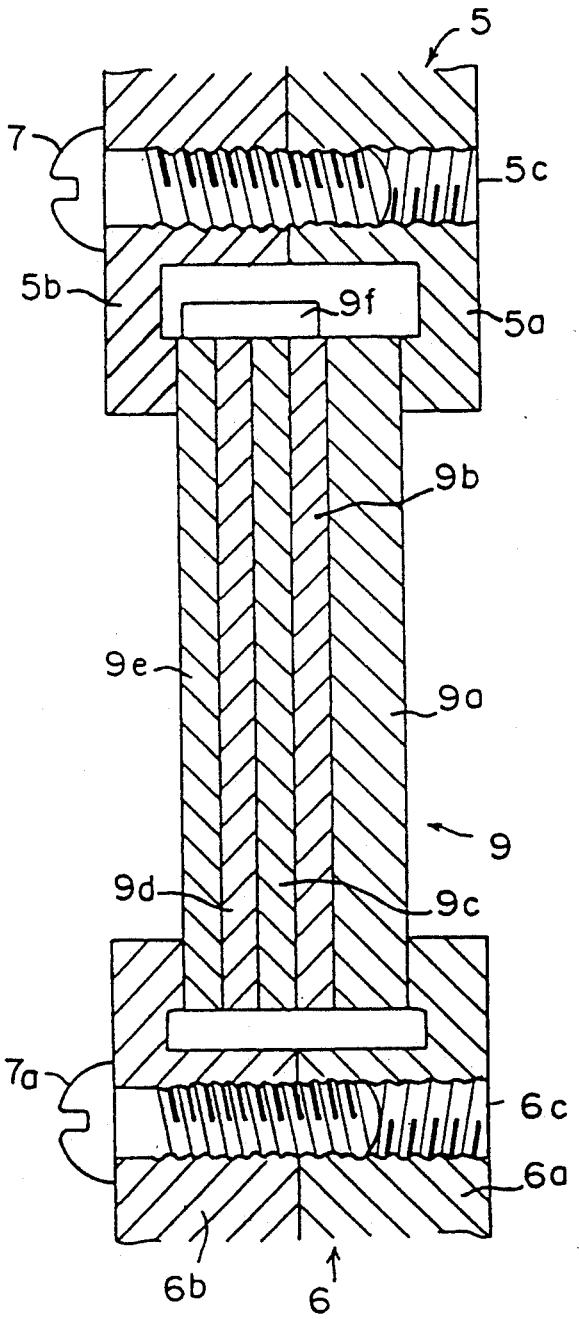
FIG. 2 is a sectional view taken along a line II—II of FIG. 1.
Figure 6:
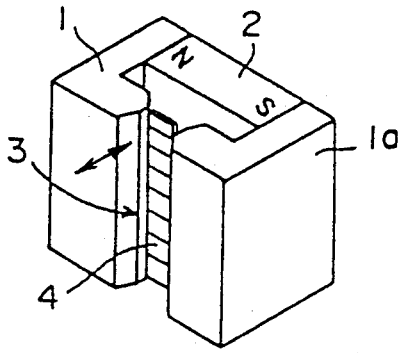
FIG. 6 is a perspective view showing a part of a conventional ribbon speaker.
Figure 7:
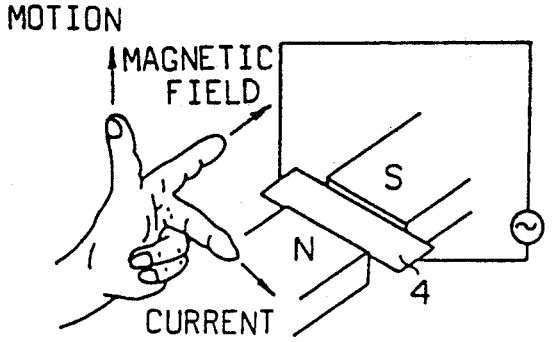
PRIOR ART FIG. 7
FIG. 7 is a diagram describing the operational principle of the ribbon speaker.

A ribbon speaker to which the present invention is applied has roughly the same construction as the conventional ribbon speaker shown in FIG. 6. Referring to FIGS. 1 and 2, the ribbon speaker has a pair of electrodes 5 and 6 for supplying audio signal to a diaphragm 9. Each of the electrodes 5 and 6 comprises two parts 5*a* and 5*b*, 6*a* and 6*b*, through which female screw 5*c*, (6*c*) is formed. The parts 5*a* and 5*b* are fastened to each other with a screw 7, and the parts 6*a* and 6*b* are fastened to each other with a screw 7*a*, interposing the ends of the diaphragm 9 therebetween. Hence the diaphragm 9 is held with a small tension. The electrodes 5 and 6 are made of a material having a small resistivity, for example, copper. In addition, the portion through which a path of the audio current is formed has a large cross-sectional area to render the resistance of the electrode as small as possible.

The diaphragm 9 is a multilayer film comprising a base 9*a*, aluminum thin film 9*b*, arachidic acid LB (Langmuir-Blodgett) film 9*c*, $C_{15}$.TCNQ (tetracyanoquinodimethane) .LB film 9*d* and a gold thin film 9*e*. The base 9*a* is a film made of a plastic such as polyimide and polyester. Alternately, the base 9*a* may be made of metal such as beryllium and aluminum, in which case the aluminum film 9*b* is obviated. It is desirable that the thickness of the base is decreased to a small value so long as the mechanical strength allows. In order to improve the efficiency and the performance of the loudspeaker, the base 9*a* is made several micrometers in thickness.

Aluminum thin film 9*b* is provided on the base 9*a* by evaporation or sputtering. The thickness of the aluminum thin film 9*b* is preferably about 500 Å. There is naturally formed an oxide film ($Al_2O_3$) of 30 Å in thickness between the aluminum thin film 9*b* and the arachidic acid LB film 9*c*.

The arachidic acid LB film 9*c*, the thickness of which is preferably between 80 and 140 Å, is formed on the aluminum thin film 9*b* by the LB method. The $C_{15}$.TCNQ.LB film 9*d* is further formed on the arachidic acid LB film 9*c* by the LB method. The thickness of the film 9*d* is preferably from 100 to 180 Å.

The gold thin film 9*e* is deposited on the $C_{15}$.TCNQ.LB film 9*d* by the evaporation or sputtering. The thickness of the gold thin film is preferably in the range of 50 to 100 Å.

If the thickness of each film is excessively larger than those mentioned above, the mass of the diaphragm 9 is increased. On the other hand, with the excessively thin film, the low resistivity of the diaphragm 9 cannot be obtained.

The aluminum thin film 9*b* and the gold thin film 9*e* are connected with each other through a metal film 9*f*, such as aluminum or gold film, for short-circuiting the films.

The arachidic LB film 9*c* is a Y type LB film so that the polarization thereof is small, and the $C_{15}$.TCNQ .LB film 9*d* is a Z type so that the polarization thereof is large. Thus the structure of the diaphragm is regarded as a diaphragm comprising an aluminum thin film/non-polar LB film/polar LB film/gold thin film. Accordingly a deep potential well which is filled with electron gas is formed between the films 9*c* an 9*d*. Hence the resistance of the diaphragm 9 is remarkably reduced, thereby providing a very high conductivity. (For reference, see Taro Hino, "Ultralow Resistivity in Langmuir-Blodgett Heterofilms", JJAP Vol 29, No. 3, 1990.)

Accordingly, whereas the resistivity of the metals are about $10^{-12}.\Omega.cm$, the resistivity of the diaphragm 9 is reduced to a value lower than $10^{-5}.\Omega.cm$ so that the resistance of the diaphragm 9 between the ends thereof is substantially zero.

In other words, the diaphragm of the present invention comprises two layers of organic thin films having different properties, which are interposed between two metal films having different work functions and short-circuited with each other. Thus, the deep potential well filled with electron gas is formed between the two organic thin films so that the resistance of the diaphragm can be greatly lowered although the thickness thereof is extremely reduced. Not only is the resistance of the diaphragm approximated zero, but also the thickness thereof is extremely reduced, thereby decreasing the mass. Hence the efficiency of the ribbon speaker is improved up to the theoretical limit of 49%.

Moreover, the width of the diaphragm can be increased so that a speaker for lower audio frequencies is obtained. Since only a small magnetic circuit is necessary to obtain the efficiency achieved by a conventional speaker, the manufacturing cost and the size of the speaker can be reduced. The mass of the diaphragm is extremely decreased so that the damping effect caused by load of air is improved. Hence the transient characteristics of the reproduced sound is improved and the harmonic distortion is decreased.

The combination of the metals used in the diaphragm 9 of the present invention may be other metals than aluminum and gold as long as the metals have different work functions. For example, magnesium may be substituted for aluminum of the aluminum thin film 9*b* and silver for gold of the gold thin film 9*e*.

The arachidic acid LB film 9*c* and the $C_{15}$.TCNQ.LB film 9*d* may also be changed, provided one of the organic films has a small polarization and the other has a large polarization. The depositing method is not confined to the LB method so long as the films are composed of a plurality of monolayers.

Figure 3:
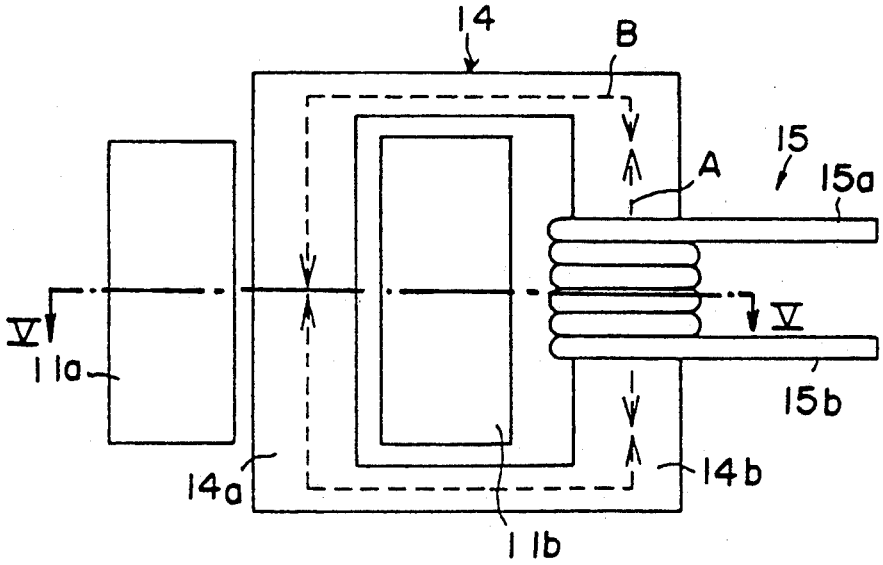
FIG. 3 is an elevational view of a ribbon speaker of a second embodiment of the present invention.
Figure 4:
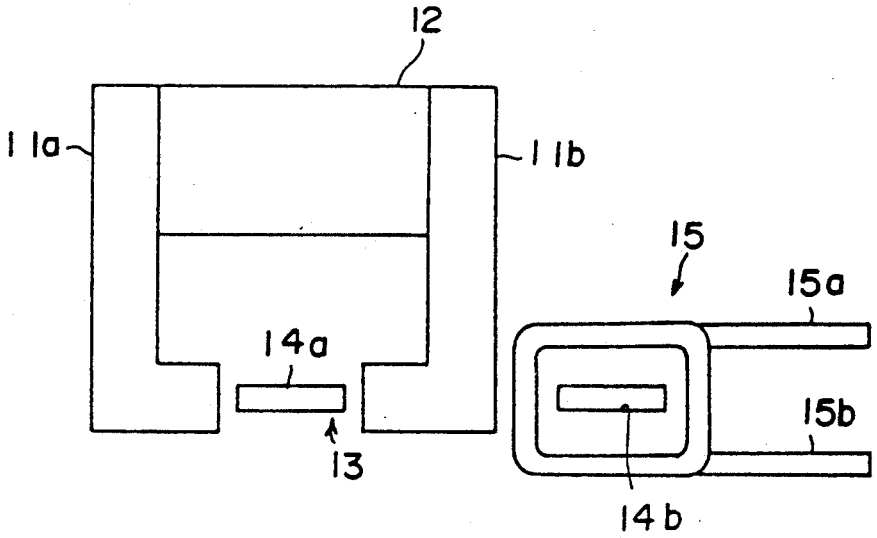
FIG. 4 is a plan view of the ribbon speaker shown in FIG. 3.

Referring to FIGS. 3 and 4, the ribbon speaker of the second embodiment of the present invention has a pair of iron yokes 11*a* and 11*b* forming a gap 13 therebetween, and a magnet 12 interposed between the yokes 11*a* and 11*b* opposing the gap 13. A longitudinally tensed diaphragm 14 having a shape of a four-sided frame forming a closed loop for current is mounted on a speaker body (not shown) through appropriate means, such that one of the sides 14*a* is positioned in the gap 13 facing the magnet 12 and the opposite side 14*b* is positioned at the outer side of the yoke 11*b*. An exciting coil 15, which is attached to the speaker body, is provided around a center portion of the side 14*b*. The coil 15 has leads 15*a* and 15*b* through which audio current is applied, thereby generating a magnetic field. As a result, current flows through the diaphragm 14 either in a direction shown by an arrow A or a direction shown by an arrow B in FIG. 3.

Figure 5:
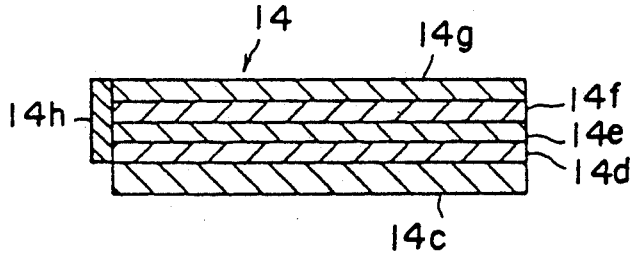
FIG. 5 is a sectional view of a diaphragm taken along a line V—V of FIG. 3.

Referring to FIG. 5, the diaphragm 14 is a multilayer film having the same construction as the diaphragm 9 described in the first embodiment. Namely, the diaphragm 14 comprises a plastic or metal base 14*c*, aluminum thin film 14*d*, arachidic acid LB film 14*e*, $C_{15}$.TCNQ.LB film 14*f*, gold thin film 14*g* and a gold thin film 14*h* for short-circuiting the aluminum thin film 14*d* and the gold film 14*g*. Thus the diaphragm 14 forms a closed circuit, the resistance of which is substantially zero.

In operation, when an exciting current (alternating current) as audio current is supplied to the coil 15 through the leads 15*a* and 15*b*, current is induced in the diaphragm 14. The current flows without a loss through the diaphragm 14 in the directions A and B. Consequently, a force in a direction perpendicular to the direction of the current is exerted on the side 14*a* facing the magnet 12. Thus the side 14*a* of the diaphragm 14 is vibrated, thereby directly radiating the sound.

The present embodiment is advantageous in that the diaphragm 14 is effectively applied with the audio signal through the excitating coil 15. More particularly, in the ribbon speaker of the first embodiment, the diaphragm is fed with audio signal through metal electrodes. Since the contact resistance at the surface of the contact between the electrode and the diaphragm is large, the level of the signal is decreased. To the contrary, the exciting coil induces the current with small loss by increasing the diameter of the coil, thereby increasing the efficiency of the loudspeaker.

The other effects of the present embodiment are the same as those of the first embodiment.

From the foregoing it will be understood that the present invention provides a ribbon speaker, the diaphragm of which has a ultralow resistance and a very small mass so that the transduction efficiency and the performance of the speaker are improved.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A ribbon speaker having a vibrating diaphragm disposed in a magnetic gap, comprising:

the vibrating diaphragm comprising first and second organic films superimposed on each other, and first and second metal films overlaid on said first and second organic films, respectively, the first organic film having a given polarization and the second organic film having a larger polarization than that of said first organic film, the first and second metal films being different in work function;

a third metal film electrically connecting the first and second metal films; and means for supplying current to the vibrating diaphragm.

2. The ribbon speaker according to claim 1 wherein the vibrating diaphragm has a ribbon shape, and the means are a pair of electrodes secured to both ends of the diaphragm.

3. The ribbon speaker according to claim 1 wherein the vibrating diaphragm has a closed loop, and the means is an exciting coil provided around a part of the diaphragm.

4. A ribbon speaker according to claim 1, further comprising:

a pair of yokes disposed adjacent to said vibrating diaphragm, with a first of said yokes adjacent to a first side of said diaphragm, and a second of said yokes adjacent to a second side of said diaphragm; and a magnet interposed between said first and second yokes, and opposed to a rear side of said vibrating diaphragm, wherein said vibrating diaphragm is longitudinally tensed between said first and second yoke.

* * * * *